United States Patent [19]

Gray

[11] 3,944,826

[45] Mar. 16, 1976

[54] METHODS AND APPARATUS FOR ANALYZING MIXTURES

[75] Inventor: Alan Lyle Gray, Harpenden, England

[73] Assignee: Applied Research Laboratories Limited, England

[22] Filed: Nov. 25, 1974

[21] Appl. No.: 526,952

Related U.S. Application Data

[63] Continuation-in-part of Ser. No. 380,762, July 19, 1973, abandoned.

[52] U.S. Cl. ..... 250/288; 250/281; 250/282; 250/423

[51] Int. Cl.[2] ..... H01J 39/34

[58] Field of Search ..... 250/281, 282, 288, 425, 250/423

[56] References Cited

UNITED STATES PATENTS

| | | | |
|---|---|---|---|
| 3,247,373 | 4/1966 | Herzog et al. | 250/288 |
| 3,318,149 | 5/1967 | Varadi | 250/288 |
| 3,406,283 | 10/1968 | Williams | 250/288 |
| 3,476,968 | 11/1969 | Omara | 250/288 |
| 3,546,449 | 12/1970 | Aspinal | 250/288 |
| 3,644,731 | 2/1972 | Eloy | 250/288 |

*Primary Examiner*—James W. Lawrence
*Assistant Examiner*—B. C. Anderson
*Attorney, Agent, or Firm*—Brisebois & Kruger

[57] ABSTRACT

A method of producing ionized material for mass analysis, in which ions are produced in a gaseous medium at high temperature in a region at substantially atmospheric pressure; the material is introduced into the medium, to be ionized, and the medium containing ions of the material is fed at low pressure to a mass analyzer.

7 Claims, 2 Drawing Figures

METHODS AND APPARATUS FOR ANALYZING MIXTURES

This is a continuation of application Ser. No. 380,762, filed July 19, 1973 now abandoned.

This invention relates to methods of and apparatus for carrying out analysis of mixtures. In this specification, analysis to be taken as including both qualitative and quantitative analysis.

The mass spectrometer can be used for analysing mixtures of substances, or substances contaminated by relatively low levels of impurities, and will detect a wide range of elements. It is specially useful in the analysis of gases or vapours or of substances that can be transformed into the gaseous state by thermal or other vaporisation without in the process altering the relative proportions of the constituents. For the analysis of highly condensable vapours, liquids, solutions and solids of high melting point or of a refractory nature, however, the problem of the introduction into the mass analyser at its low operating pressure of ionized atoms from the sample in the same relative concentrations in which they are present in the sample is very severe.

There are various types of scientific and industrial apparatus in which it is necessary to produce ions, in a gaseous state, of a material under examination, but the choice of method of ionisation adopted is influenced by the nature of the ionisation required In some apparatus, for example, multiply charged ions may be required; in the case of a mass spectrometer or like instrument in which the operation of the instrument is related to the mass/charge ratio, it is very desirable that the ions should be singly charged and that there should be a minimum spread of energies of the ions.

In the case of mass spectrometers and the like instruments, a number of ionization methods are possible but it is desirable that the method used should be capable of dealing with a variety of materials, as mentioned above, and should produce the highest possible proportion of singly charged ions the energies of which lie within a range which is as restricted as is reasonably possible. These requirements are in addition to the essential requirement that the ions should represent a true sample of the material under examination.

Various ionization methods are known in which vapour is first produced from the sample, the vapour containing components from all the species present, and then introduced into the mass analyser through an appropriate ionization chamber to produce the necessary ions or, if the vapour atoms as produced are already ionized, directly into the mass analyser. While these methods may be applied to the analysis of certain elements in a mixture, they are not in general applicable to all the elements of the periodic table, and, where the sample is a mixture, possess the draw-back of volatilising the components of the sample at different rates owing to the different vapour pressures possessed by the components at any given temperature. In general, the introduction of a sample into a mass spectrometer is complicated both by the need to operate most ion sources at a pressure well below atmospheric and by the physical nature of the sample itself. The known arrangements, used in practice, have in common the fact that ionisation is effected in a region at low pressure.

In British Pat. specification No. 835,118 there has been suggested a method of ionization in which in a discharge apparatus an anode space containing a discharge anode and a cathode space containing a discharge cathode are in communication through a nozzle. Different gas pressures are established in the two spaces, so that a high temperature arc discharge occurs at the electrode associated with the space at higher pressure, while a heavy current glow discharge takes place at the electrode associated with the space at lower pressure, the cathode being without separate heating means. The object of the method of this British specification is to produce the highest possible probability of ionisation. Examples of the high and low pressures used are 40 mm. and 0.001 mm. of mercury.

In U.S. Pat. No. 3602595 there is described a method of producing ions by forming an arc between a counter-electrode anode and a cathode consisting of a material to be ionised. The small droplets of material produced are carried away as an aerosol.

The invention concerns an apparatus for producing ions of a sample material, by means of an electric discharge in an atmosphere which is at or near atmospheric pressure, that is, normal terrestrial atmosphere not substantially lower than 760 Torr. As a result of using this high pressure, the discharge is in partial thermal equilibrium; further reference is made hereinafter to the nature of this condition.

An object of the invention is to provide a method of and means for producing ions suitable for use with a mass spectrometer or the like, in which the range of ion energies is reduced and a very high proportion of the ions are singly charged.

In accordance with the invention there is provided a method of analysis of a material which comprises the steps of:

a. providing a gaseous medium;
b. subjecting said gaseous medium in a first region thereof substantially at atmospheric pressure to the action of high temperature in a zone substantially in a condition of local thermal equilibrium thereby to establish a high temperature plasma state in said medium;
c. embodying said material in said medium thereby to produce ionisation of said material in said medium;
d. transferring a portion of said gaseous medium containing said ionized material to a second region at a pressure substantially lower than the pressure in said first region; and
e. transferring said ionized material from said second region to a mass analyser.

By means of the invention it is possible to use methods of examination which offer the advantage of avoiding the need to introduce the sample to a region of very low pressure and defers the reduction of pressure to the level at which the mass analyser operates most efficiently, that is, to the last stages of the operation. In addition the methods can be adapted for use with finely divided solids, liquids, vapours and gases and by the use of an appropriate preliminary stage incorporating for example an aerosol generator or a laser beam can accept samples as massive solids.

In a preferred form of the invention described in more detail hereinafter, a high temperature plasma is used, preferably with an equilibrium gas temperature in the range 4,000° to 6,000° K. Such a plasma can be obtained by an electrically maintained discharge in a suitable gas such as argon at atmospheric pressure. The discharge is preferably achieved as a low voltage direct current capillary arc between a fine pointed cathode and a cold anode, confined for example by the walls of a tube along which the gas, forming the plasma medium, is passed. Alternatively, a radio frequency field can be used, coupled by a suitably placed exciting coil, cavity or waveguide, to maintain an electrode-less discharge in the gas.

One such a plasma is stably established, samples to be analysed are injected into the gas supply which feeds the plasma. Where the sample is a gas or vapour at atmospheric pressure or higher, it can be bled into the plasma gas feed through a suitable metering jet. When the sample is a liquid it is necessary to form from it an aerosol or cloud of fine droplets which can then be injected into the plasma gas supply. With liquid solutions it is preferable to remove the solvent from such droplets by a desolvation stage before injection. Solid samples, in the form of powders fine enough to remain in suspension in the gas, can be similarly injected; typically, powders of a few microns diameter particles or less are suitable. Massive solid samples have hitherto presented the greatest difficulty for introduction to the mass spectrometer and the techniques of spark sources and ion bombardment sources are the only practicable solutions so far adopted for this. Both however are very costly, require the sample to be put into a high vacuum and produce ions with wide energy distributions and are thus not suitable for rapid routine use.

In the method of the inventions there are two ways of producing a fine dispersion of solid particles in the carrier gas stream feeding the plasma from massive solid samples, which are especially suitable.

The first of these ways is by means of an aerosol generator in which a unidirectional electric arc is struck in a gaseous atmosphere between an anode and the sample, which is made the cathode of the arc. Where the sample is an electrical conductor it can be used directly as the electrode, the only preparation needed being the provision of a clean surface at which the discharge can be struck. Where the sample is an insulator, the sample is used to prepare a conductive composite; for example, if the sample is a powder, such as a mineral powder, an intimate mixture with graphite or a metal is made and compressed into a solid "briquette" in the manner which is commonly used for x-ray fluorescence analysis. The relative proportions of the sample and conductor are chosen to produce a suitably low resistance compact. Because the arc is unidirectional or direct current, the erosion of the electrode is confined substantially to the cathode, that is, to the sample and as the arc wanders about over the available surface erosion is spread over a significant area of the sample, producing a pitted appearance. The eroded material in the discharge is in the form of an aerosol of minute particles in size ranging downward from about one micrometre. If the gas in which the discharge takes place, which may typically be argon or helium, is allowed to flow from the discharge area away down a tube it will carry with it the particles produced from the sample. These particles have a composition which is truly representative of the sample composition.

A second method makes use of a pulsed laser beam to extract material from the sample; in this case the sample can be a non-conducting solid in its original form, thus avoiding the need for sample preparation.

A convenient way of using the laser beam to prepare the samples is to focus the beam on to the surface of the sample in the presence of a carrier gas, preferably an inert gas such as argon and helium, and typically at atmospheric pressure. The plume of material which is extracted from the surface by the laser beam rapidly reaches equilibrium by collision with the carrier gas and the excited atoms return to their ground states and the ions recombine to form atoms again. The extracted material from the sample material is then conveyed by flowing the carrier gas into the plasma which is used as the ion source for a mass spectrometer, as described above. In this way a major part of the material extracted from the surface is analysed and the analysis is not interfered with by the complex state of the material immediately after the extraction process.

Because of the very small size of the laser spot on the sample surface. typically 10 micrometres in diameter, the analysis of a heterogeneous material could differ on successive occasions due to the laser beam being focussed on a different phase of the surface. If however, the sample is moved or rotated with respect to the beam position between successive laser pulses, so that each laser pulse strikes a fresh sample surface, the reproducibility of the analysis is greatly improved and calibration standards can be used in the way which is common practice in analytical techniques. This is greatly facilitated by the method of allowing the extracted plume to come to equilibrium with the carrier gas so that an integrated measurement may be made over a large number of successive laser pulses while the carrier gas is fed to the analyzing plasma. In this way substantially all the extracted material can be analyzed and differential and rate effects, due to the very high input energy rate of the laser beam, avoided.

Once the sample in any of these forms is entrained in the plasma gas feed it is carried into the plasma. At the temperature involved particulate solids and liquids are immediately vaporised, and their behaviour is then the same as gas or vapour samples after such samples have reached the plasma. At these temperatures the molecules of the sample are substantially dissociated into their constituent atoms which are then ionized with a high yield of singly charged ions.

The plasma can be sampled by means of suitable plasma diagnostic techniques. A convenient method is to extract neutral or ionized atoms from the plasma through a fine orifice in a suitably shaped diaphragm which forms a boundary of a low pressure region. The ions or atoms escaping into this region are then suitably formed into a fine beam which is passed through successive pressure reduction stages into the mass analyzer of a mass spectrometer with or without assistance from a suitable electric field. Alternatively, the plasma can be sampled for neutral sample atoms which are then injected into a separate ion source, typically of the electron impact variety, in which the ionisation process may be controlled to produce predominately singly charged ions of low energy spread.

Simultaneous vaporisation and ionisation can be effected in an apparatus in which the sample aerosol is fed directly at the pressure of the sample introduction into the plasma, which can be of any of the forms described above, where it is both vaporised and ionized. Conveniently, the ions can be extracted, either on or at right angles to the plasma axis, through an orifice in a thin diaphragm separating the plasma vessel and the mass analyser vessel. The orifice is typically between 2 and 10 thousandths of an inch in diameter.

The method and apparatus of the invention involves the production of ions, in a region at substantially atmospheric pressure, by discharge in a zone which is in substantially thermal equilibrium. It is not feasible to have the region in which the discharge takes place wholly in thermal equilibrium, since the walls of the containment of the region, for example, cannot be at the temperature of the discharge but it is feasible to maintain the thermal equilibrium in the core or zone of the region in which the discharge takes place.

The condition of thermal equilibrium for the plasma can be variously defined, and in a condition of thermal equilibrium the definitions are equally valid. Thus, the definition can be in relation to the gas temperature as defined by the kinetic energy of the neutral atoms; the electron temperature, as defined by the kinetic energy of the electrons; the excitation temperature, which refers to the population of the various excited states which exist and the ionization temperature, which refers to the ionisation equilibrium.

In practice, any differences between these temperatures depends on the ratio of gas pressure to electric field (p/E). At low pressures or in high fields, the gas temperature is low and the electron temperature high.

When the plasma is in thermal equilibrium, that is when all the temperatures have come to the same value, the important advantages are obtained:
Firstly, the gas temperature is at its highest and thus the thermal effect on an introduced sample is optimum, i.e. it is vaporized and dissociated rapidly. This is particularly important for solid particles. Secondly, ions are produced entirely by the thermal ionization process and have low energies because since the mean free path is small they retain the kinetic energy of the population around them, and because of the high current density and low voltage drop of an atmospheric pressure discharge, the electric field is small.

These advantages are very important for analysis of sample introduced into the carrier gas. The first point ensures that the sample is reduced to atomic vapour before it is blown past the hottest part of the discharge. The second point is doubly advantageous in that the ions have a small distribution of kinetic energy, therefore they can subsequently be analyzed by a simple type of mass analyzer without an energy analysing stage, and, further, because they are not subjected to electron bombardment at high fields there is very little electron impact ionization which can lead to double ionization, and higher states in extreme cases, which gives additional confusing spectral lines.

The temperature must be high enough to produce adequate vaporisation, dissociation and ionization and not too high to produce by itself higher states of ionization. The ideal temperature depends on the sample state and its atomic composition, the figures of 4,000°–6,000° K mentioned are a compromise that is acceptable for most purposes, though other temperatures are possible.

These advantages stem from the state of near thermal equilibrium. If this could be obtained at low pressure, then the advantages could also substantially be obtained, but thermal equilibrium is not obtained at pressures significantly below atmospheric; the lower limit is about 500 Torr. It improves above atmospheric but some convenience is lost.

Thus the main advantage of the sample introduction system and ion source combination described is lost if it is operated at the low pressure.

There is a modified form of the invention which is also useful, in which, an arc is established, at substantially atmospheric pressure, to vaporise and dissociate a sample; the neutral produce is then introduced through an orifice into a low pressure zone where a low pressure ion source is disposed.

This sequential vaporisation and ionisation affords more independent control over the conditions of ionization. The sample aerosol can be vaporised in a plasma in the manner described above and the plasma sampled by an orifice as before. Beyond this orifice, however, the stream of ions and neutral atoms, which are normally obtained simultaneously, may have the ions removed from it, typically by means of a transverse electric field, and then be allowed to pass into an ion source of the well-known electron impact type. In this source the beam of neutral atoms is subjected to bombardment by an electron beam under closely controlled conditions. A proportion of the sample atoms will thus be ionized and may then be permitted to enter the mass analyser.

Different embodiments of apparatus for carrying out the methods described are illustrated in FIGS. 1 and 2 of the drawings, in which:

FIG. 1 shows an arrangement in which a sample is obtained by arc discharge, and the sample vaporized by capillary discharge, the two stages being at the same pressure.

An arc is established between the sample, provided as a sample compact 10, as the cathode and an anode 11, within a closed space defined by a chamber 12. A carrier gas, such as argon or helium, is introduced at 13 and the carrier gas containing particles of the sample material leaves the chamber at 14 and fed to the following plasma. In this stage an arc is established in a chamber 15, between an electrode, such as the anode, at 16 and the other electrode at 17; the discharge is confined to a capillary region at 18. The carrier gas containing sample particles is admitted at 19 and main gas flow leaves the chamber at 20, a small part of the flow leaving through an orifice at 21, and passing at 22 to the mass analyzer. A vacuum pump connection is indicated at 23.

Figure 1:
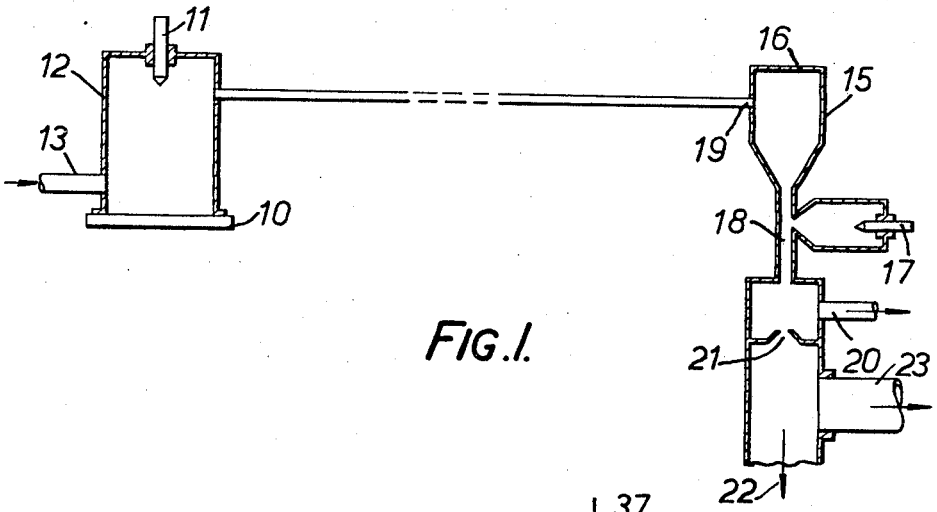
FIG. 1 is a schematic representation of an apparatus in which a sample is obtained by arc discharge.
Figure 2:
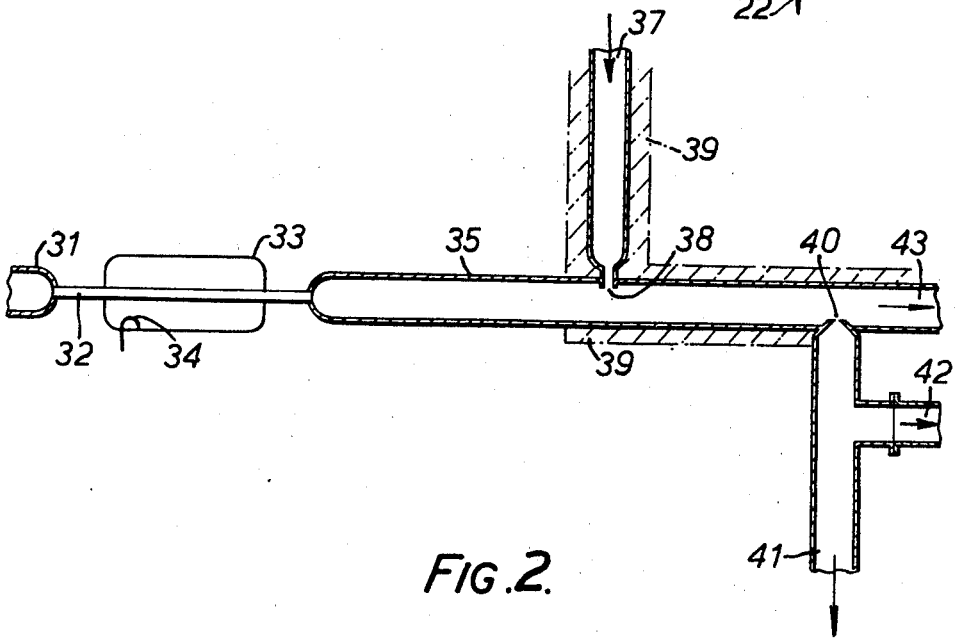
FIG. 2 is a schematic representation of an apparatus in which a sample is obtained by a chemical reaction.

For other types of sample the sampling discharge, shown in FIG. 1, between the electrode 11 and the sample 10, can be replaced by a pulsed laser beam which enters the chamber through a lens by which the beam is focussed on the sample surface. The carrier gas then carries the sample vapour plume to the plasma as before. In another alternative, the sampling discharge chamber, or aerosol generator, can be replaced by a liquid nebuliser and desolvator to enable liquid or solutions to be analysed. Gases or vapours can be admitted directly to the carrier gas stream and carried to the plasma as before. As in the other examples described the sample will be dissociated by the high temperature plasma into its constituent atoms.

In determining the constitution of a mixture it may not always be convenient to reduce it to its constituent atoms, since information concerning the structure of the components of the mixture is destroyed. For example, in the analysis of the components of the gaseous contents of a chemical reactor in which various stages of the manufacture of organic polymers are in process, it may be desired to determine the relative abundance of the various components without destroying their molecular form. If a sample of the contents, which may be at a temperature of a few hundred degrees centrigrade and not able to be cooled below this without condensation occurring is fed to the sample inlet to a plasma as described it will of course on entering the plasma be completely dissociated into its constituent atoms, typically carbon, hydrogen and oxygen, and all information as to the molecule composition of the components of the mixture will be lost.

Molecules analysis may however be achieved if a sample is fed into the plasma tail stream. To accomplish this, a plasma is stably established in a stream of carrier gas fed through it in the manner already described. The carrier gas which may typically be argon or helium, will contain a high proportion of ionised atoms which will be carried out of the high temperature region and persist in the tail stream of flowing gas; in this case no sample is added up-stream of the plasma, so only the carrier gas ions are present. As this carrier gas stream leaves the high temperature region, it cools, eventually to ambient temperature, so that along the tail stream, positions exist where the temperature lies between ambient and the highest plasma temperature. The density of the ion population will decrease with distance from the high temperature position, due to recombination.

In order to analyse a sample which cannot be heated to a high temperature without destroying its molecular structure, the sample is injected into the tail stream at a position which is at a temperature at which structural information will not be destroyed. To maintain the temperature of the subsequent part of the tail stream high enough for the succeeding stages of the process it may be necessary to prevent further cooling beyond the sample injection point by suitable thermal jacketting or heating. The sample at this point may be in the form of a gas or vapour withdrawn as such from a chemical process, but if necessary appropriate provision can be made to produce the sample as a gas or vapour prior to injection.

Once the sample molecules are mixed into the ionised stream of carrier gas from the plasma they will become ionised by a process of charge exchange with it and at a suitable position below the sample injection point the gas stream will contain neutral carrier gas atoms, carrier gas ions, neutral sample molecules, ionized sample molecules and neutral and ionised reaction products or molecular fragments which result from ion-molecule reactions taking place in the gas stream between the components of the sample.

This carrier gas stream can then be sampled by the same means, described above for plasma sampling in which ions are extracted through a fine orifice in a suitably shaped disphragm which forms the boundary of a low pressure region. The ions escaping into this region are then passed into the mass analyser of a mass spectrometer in the way already described.

An apparatus suitable for carrying out this method is shown in FIG. 4. In this arrangement a sample is obtained from a chemical process reactor at above atmospheric pressure and a temperature of 300° C and is allowed to expand through an orifice into the plasma tail stream at a point at which it is also at 300° C.

A stream of carrier gas such as argon or helium is fed through an entrance tube 31 to a capillary 32 which passes through the centre of a microwave cavity 33. This cavity is excited by energy from a microwave generator, fed by coupling 34 and the plasma is formed in the capillary passing through it. The ionised carrier gas which streams from the plasma passes through a further tube 35 along which its temperature falls until a position 36 is reached where the temperature is substantially that of the incoming sample 37. This sample is conveyed by a thermally jacketted tube to an injection orifice 38 through which it is expanded into the tail stream of the plasma. Charge exchange and ion molecule reactions take place in the reaction region of the tube 39, which is maintained at the sample temperature. At an appropriate point along tube 39 the reaction product ions are sampled by the small orifice 40 and passed into pressure reduction stages through the manifold 41 to the spectrometer. Scattered neutral products are pumped away by vacuum pumps connected to the manifold 42. The carrier gas passes from the reaction zone through the outlet 43 to exhaust.

The mass spectra produced by the spectrometer will contain information on mass and abundance of the ionised products of the charge exchange and ion-molecule reaction processes occurring in the tail stream subsequent to the sample injection, from which the original sample composition may be deduced in a manner similar to that used for electron impact ionisation mass spectrometry of organic molecules. In certain cases information on the neutral molecules and fragments sampled by the orifice may also be required and in such cases a normal electron impact ionization source can be used to produce ions for subsequent mass analysis, though such a source is likely to produce further fragmentation of the molecules and fragments.

What I claim is:

1. A method of analyzing a material which comprises the steps of:
   a. providing a gaseous medium;
   b. introducing said material into said medium;
   c. ionizing at least part of said medium in a first region to convert it to a plasma state, and thereby ionize said introduced material, with said plasma at substantially atmospheric pressure and substantially in a condition of thermal equilibrium;
   d. transferring a portion of said gaseous medium containing said ionized material to a second region at a pressure substantially lower than the pressure in said first region; and
   e. transferring said ionized material from said second region to a mass analyzer.

2. A method in accordance with claim 1, and including the step of introducing a liquid material to said first region as an aerosol.

3. A method as claimed in claim 1 in which said medium is ionized by producing an electric discharge in said first region.

4. A method as claimed in claim 1 including the steps of producing a fine dispersion of solid particles of said material from a solid sample thereof by means of an electric arc, and introducing said dispersion into said gaseous medium.

5. A method in accordance with claim 1 including the steps of producing a fine dispersion of solid particles of said material by the impact of a pulsed laser beam on the solid sample; and introducing said dispersion into said gaseous medium.

6. A method of analyzing a compound the constitution of which changes with temperature, which method comprises the steps of:
   a. providing a gaseous medium;
   b. ionizing at least part of said medium in a first region at a temperature above the temperature at which said compound will thermally change, the pressure of the medium in said region being substantially at atmospheric pressure;

c. causing the temperature of the ionized medium to fall to a temperature which is at most slightly greater than the said temperature of thermal change of the compound, thereby providing a cooled quantity of said medium containing ions of the medium;

d. introducing neutral particles of said compound into said cooled portion of the medium and thereby producing ions of said compound;

e. transferring a portion of said gaseous medium containing ions of said compound to a second region at a pressure substantially less than atmospheric pressure, and f. transferring said ions of the compound from said second region to a mass analyzer.

7. A method of analysis of a material which comprises the steps of:

a. providing a gaseous medium;

b. subjecting said gaseous medium in a first region thereof substantially at atmospheric pressure to the action of high temperature in a zone substantially in a condition of local thermal equilibrium thereby to establish a high temperature plasma state in said medium;

c. embodying said material in said medium thereby to produce ionisation of said material in said medium;

d. transferring a portion of said gaseous medium containing said ionised material to a second region at a pressure substantially lower than the pressure in said first region; and e. transferring said ionised material from said second region to a mass analyser.

* * * * *